US005383522A

United States Patent [19]

Hailey

[11] Patent Number: 5,383,522

[45] Date of Patent: Jan. 24, 1995

[54] WHIPSTOCK AND METHOD

[75] Inventor: Charles D. Hailey, 1162 Burning Oak Rd., Oklahoma City, Okla. 73150

[73] Assignees: Atlantic Richfield Company, Los Angeles, Calif.; Charles D. Hailey, Oklahoma City, Okla. ; a part interest

[21] Appl. No.: 242,764

[22] Filed: May 16, 1994

[51] Int. Cl.[6] ..... E21B 7/08

[52] U.S. Cl. ..... 166/382; 166/177.5; 175/61; 175/80

[58] Field of Search ..... 166/117.6, 117.5, 382; 175/61, 79, 80, 81, 82

[56] References Cited

U.S. PATENT DOCUMENTS

| | | | |
|---|---|---|---|
| 2,103,622 | 12/1937 | Kinzbach | 175/82 X |
| 2,216,963 | 10/1940 | Sinclair | 175/82 X |
| 2,362,529 | 11/1944 | Barrett et al. | 166/117.6 X |
| 3,095,039 | 6/1963 | Konzbach | 175/81 |

*Primary Examiner*—Hoang C. Dang

*Attorney, Agent, or Firm*—Roderick W. MacDonald

[57] ABSTRACT

A whipstock and method of using same wherein first and second opposing ends of the whipstock are joined by opposing back and guide surfaces and the second or upper end of the whipstock is composed of at least two surfaces, the first surface being angled so as to direct a well tool impinging thereon toward the guide surface and the second surface being angled so as to provide support for the whipstock when placed in a wellbore at an angle to the long axis of the wellbore.

19 Claims, 2 Drawing Sheets

WHIPSTOCK AND METHOD

BACKGROUND OF THE INVENTION

Whipstocks are well known devices used in various well operations to deviate one or more well tools from a direction along the long axis of a wellbore. This way the well tools will operate at an angle to the long axis of the wellbore. This is done in order to drill deviated wellbores that extend into the earth at an angle to the long axis of the main or primary wellbore from which the deviated wellbore is drilled.

The standard whipstock is a long tool anywhere from ten to twenty feet or more, which takes the shape of a very long right triangle. The short base of the right triangle is the bottom of the whipstock in the wellbore. An upstanding back surface intersects the base at essentially a right angle. The hypotenuse is the gently sloping guide surface of the whipstock which forces the well tools into a direction which is at an angle to the long axis of the main wellbore.

Normally, when a whipstock is set in a wellbore such as one lined with conventional steel conduit such as casing, the back surface of the whipstock rests in essentially its entirety against the inner wall or surface of the casing. Thus, the whipstock is supported along essentially its entire back surface length by contact with the wellbore or the casing lining same. When the whipstock bottom is set on a rigid anchor or cement plug, the whipstock is well supported over the full length of its bottom surface and its back surface with only the guide surface left unsupported and pointing generally upwardly to receive the impact of downward traveling well tools in order to direct those well tools away from the long axis of the wellbore.

Sometimes the interior of the main wellbore has one or more restrictions along the length thereof which reduce the cross-sectional area of the wellbore. Thus, whatever tool that is passed down the interior of that wellbore has to be small enough in cross-section to pass through those restrictions in order to reach lower levels in the wellbore. There are many restrictions that can be imposed in a wellbore and this invention is applicable to all of them, but for sake of clarity, the only restriction referred to hereinafter will be that of a string of production tubing that is carried concentrically within the main wellbore and that is of a smaller internal diameter than the wellbore itself or any casing lining the wellbore itself. This is called through tubing operations in that any well operations that are to be carried out in the wellbore below the end of the production tubing has to be passed through the interior of the production tubing before it can reach the area where the well operation is to be carried out. Otherwise the production tubing has to be removed in its entirety from the wellbore, which is an expensive and time consuming process. Thus, it is very desirable to be able to pass well tools that are to be used in well operations through the interior of the smaller diameter production tubing down below the end of that tubing into the larger diameter wellbore and then carrying out well operations with those tools in that larger area of the wellbore.

Often times well tools that are made small enough to pass through restrictions such as production tubing do not operate as well in the larger wellbore area below the end of the production tubing and this includes whipstocks. This is so because the small tools do not take up the space afforded by the larger wellbore area, and, therefore, there is more room for operating error such as a mill jumping off the guide surface of a whipstock.

This invention is directed toward a whipstock modified so that it can be passed through one or more restrictions within a wellbore and still operate reliably in the larger diameter area of the wellbore below the end of any such restriction.

SUMMARY OF THE INVENTION

This invention is directed to a whipstock for emplacement in a wellbore after having passed through at least one restricted area in that wellbore, the whipstock being modified at its upper end, as emplaced in the wellbore, to provide a first surface which directs a well tool impinging on that first surface toward the conventional guide surface of the whipstock and a second surface which provides support for the whipstock when the whipstock is emplaced in the wellbore at an angle to the long axis of that wellbore.

This invention is also directed toward a method for carrying out well operations involving setting a whipstock wherein the above described whipstock of this invention is employed in that method including tilting the whipstock relative to the long axis of the wellbore so that the aforesaid second surface essentially rests against the exposed internal wall or surface of the wellbore for support purposes.

Accordingly, it is an object of this invention to provide a new and improved whipstock for use in wellbores having one or more restrictions along the length thereof.

It is another object to provide a new and improved method for setting a whipstock in a supported manner after its has passed through one or more restrictions in a wellbore.

Other aspects, objects and advantages of this invention will be apparent to those skilled in the art from this disclosure and the appended claims.

DETAILED DESCRIPTION OF THE INVENTION

Figure 1:
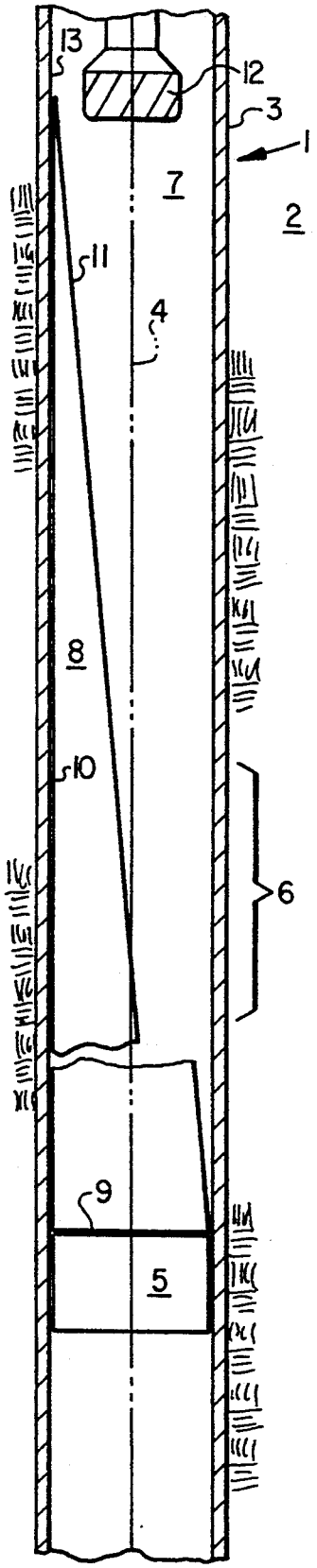
FIG. 1 shows a conventional whipstock emplaced in a wellbore in the normal manner with essentially its entire back surface supported by an exposed internal surface of the wellbore.

FIG. 1 shows a portion of main wellbore 1 in the earth 2 which is lined by casing 3 and which has a long axis 4. A conventional packer-anchor 5 or cement plug is set in the wellbore inside casing 3 at a desired point above which it is desired to mill a window in casing 3 in area 6. The window is desired to be milled to provide an aperture through which well tools can be deviated to form a lateral wellbore that extends at an angle to long axis 4, e.g., a deviated wellbore such as a horizontal wellbore. In order to divert well tools in interior 7 of casing 3 toward area 6 to carry out milling operations to form the desired window, a conventional whipstock 8 is set firmly down on anchor 5.

Whipstock 8 is composed of a bottom surface 9 and upstanding at a right angle thereto a back surface 10. The hypotenuse side of the this right triangle is guide surface 11 which has a groove milled therein to serve to guide well tools impinging thereon away from long axis 4 and toward area 6. Thus, for example, a mill 12 lowered on conventional straight jointed pipe or coiled tubing or the like (not shown) from the earth's surface impinges on guide surface 11 and thereby deflected toward area 6 so that mill 12 can mill the desired window through a portion of the wall of casing 5 in area 6. Thereafter drilling tools can be lowered into the wellbore, pass through the window formed in area 6, and a deviated hole drilled at an angle to long axis 4.

It should be noted that whipstock 8 as emplaced on anchor 5 inside casing 3 has bottom surface 9 resting firmly on anchor 5 and back surface 10 just as firmly supported over essentially its entire length by contact with inner surface 13 of casing 3. Thus, when mill 12 impinges on guide surface 11 there is no give or flex by surface 9 toward anchor 5 or surface 10 toward inner surface 13.

Figure 2:
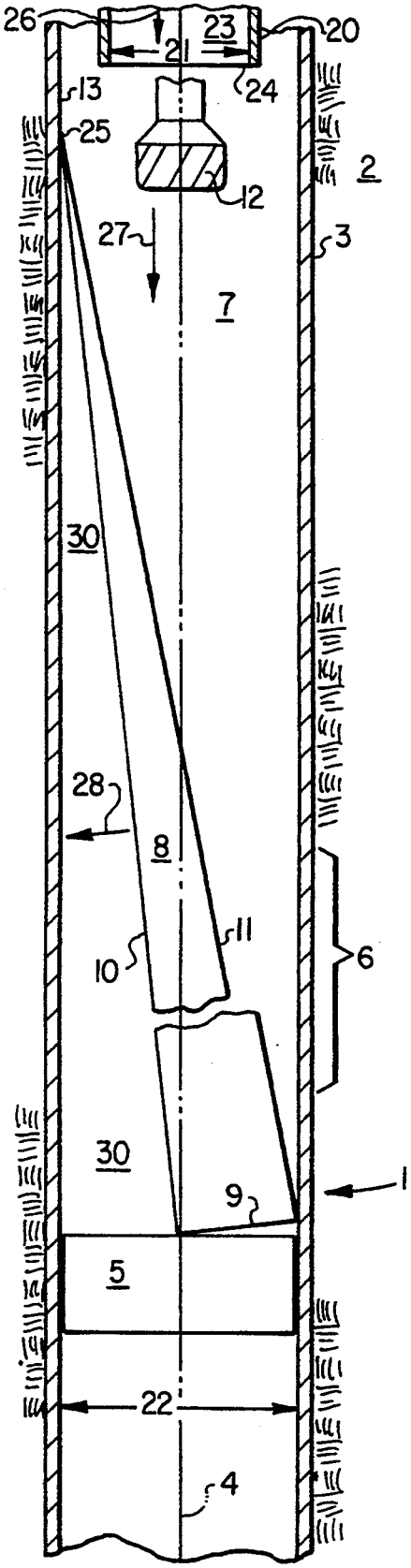
FIG 2 shows a conventional whipstock emplaced in a large area within a wellbore below a restriction, and demonstrates the unsupported nature of a conventional whipstock as so emplaced.

FIG. 2 shows the same wellbore setup except that a restriction has been imposed in inner area 7 of casing 3 above anchor 5, the restriction in FIG. 2 being a string of conventional production tubing 20. Tubing 20 has a substantially smaller inner diameter 21 than inner diameter 22 of casing 3. In order for whipstock 8 to be able to pass through small cross-sectional interior 23 of tubing 20, assuming that tubing 20 either can not or desirably is not removed from interior 7, whipstock 8 must be of a smaller diameter than it would be in the situation of FIG. 1 where there is no restriction in inner space 7 above anchor 5. This leads to the situation that a smaller than normal whipstock 8 is passed through interior 23 of production tubing 20 but then has to operate in the larger inner area 7 inside casing 3 below lower end 24 of production tubing 20.

If a conventional prior art whipstock is employed in such a situation the whipstock will be tilted at an angle to long axis 4 when it comes to rest on anchor 5 as shown in FIG. 2 so that only a very small top portion 25 of whipstock 8 is supported by inner surface 13 of casing 3. When mill 12 is lowered through interior 23 as shown by arrow 26 until it impinges upon guide surface 11 as shown by arrow 27, unsupported back surface 10 of whipstock 8 tends to give or flex in the direction of arrow 28. Due to such flexure, the cutting elements of mill 12 tend to bite into guide surface 11 rather than inner surface 13. It is well known that once a cutting member takes a bite into another member it is preferentially drawn toward the member in which it is biting. Thus, in the situation of FIG. 2, with whipstock 8 flexing away from area 6 by the weight of mill 2 and the tubing that carries mill 12, mill 12 tends preferentially to bite into guide surface 11 and thereafter be pulled toward whipstock 8 and away from area 6. This is just the reverse of what is desired for this type of well operation.

It can be seen from FIG. 2 that back surface 10 is no longer supported by inner surface 13 of casing 3 because of space 30, shown in exaggerated form in FIG. 2 for sake of clarity. It is space 30 which allows flexure in the direction of arrow 28 by impingement of well tool 12 on guide surface 11. This flexure has two disadvantages, in that it lets well tool 12 get further down along guide surface 11 than is desired and, as mentioned before, encourages mill 12 to bite preferentially into guide surface 11 rather than inner surface 13. If mill 12 impinges on guide surface 11 very far down along guide surface 11, the flexure can be substantial because mill 12 can be carried from the earth's surface by thousands of feet of steel pipe so that it is easy to put, even without trying, substantial weight on whipstock 8. When substantial weight is placed upon whipstock 8 and it is supported only by a very small portion of back surface 10 as represented by reference numeral 25, substantial flexure can be encountered even though whipstock 8 is made of steel and even if whipstock 8 is re-enforced.

Figure 3:
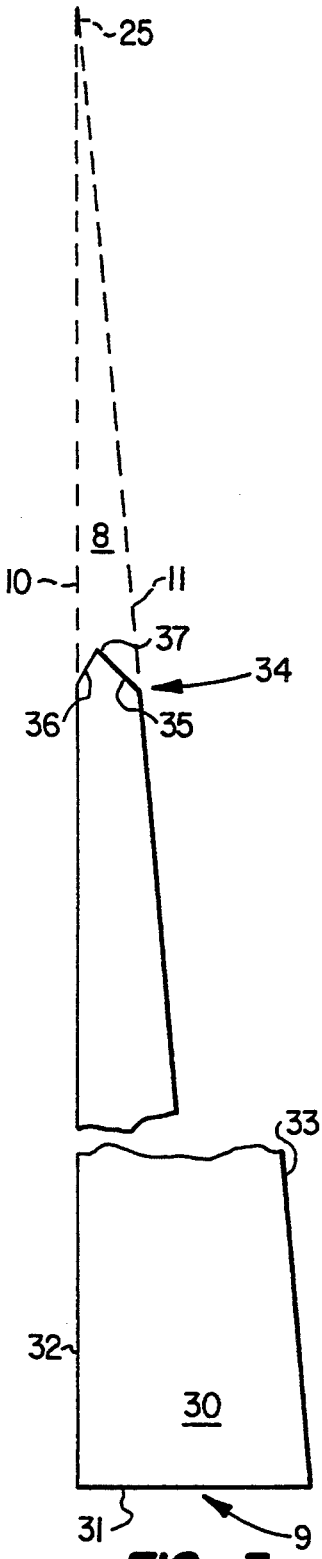
FIG. 3 shows a comparison between a conventional whipstock and the whipstock of this invention.

FIG. 3 shows a whipstock 30 in accordance with this invention superimposed on conventional whipstock 8 of FIGS. 1 and 2. The differences between whipstock 30 of this invention and that of the prior art are now clearly seen. In FIG. 3, conventional whipstock 8 is shown behind whipstock 30 so that bottom surface 31 of whipstock 30 is contiguous and coexistent with bottom surface 9 of whipstock 8. Similarly, back surface 32 of whipstock 30 is contiguous with back surface 10 of whipstock 8 and guide surface 33 of whipstock 30 is contiguous with guide surface 11 of whipstock 8.

In FIG. 3, whipstock 30 is shown to have at its upper second end 34 opposing bottom surface or first end 31. First end 31 and second end 34 are joined together by opposing back and guide surfaces 32 and 33, respectively. Second end 34 is shown to be composed of at least two surfaces 35 and 36 which approach one another and, in that embodiment, actually intersect at point 37. First surface 35 also approaches guide surface 33 while second surface 36 approaches back surface 32. In this embodiment, surface 35 actually intersects surface 33 while surface 36 actually intersects surface 32. Thus, second surface 36 can be considered a portion of back surface 32 which angles away from back surface 32, unlike conventional whipstock 8 whose back surface continues in a straight line to apex 25. Similarly, first surface 35 can be considered a portion of guide surface 33 which angles away from guide surface 33 rather than continuing in a straight line such as guide surface 11 to apex 25. The particular angular relationships between first and second surfaces 35 and 36 in relation to back surface 32 is explained in greater detail hereinafter. From FIG. 3 it can be seen that the second or upper end 34 is of a significantly different configuration than conventional whipstock 8.

When whipstock 30 of FIG. 3 is passed through a restriction in a wellbore such as production tubing 20 of FIG. 2 and emplaced on anchor 5, it comes to rest on anchor 5 and tilts at an angle to long axis 4 of wellbore 1 in the manner shown in FIG. 2. However, due to the unique whipstock configuration of second end 34, second surface 36 provides a substantial contact surface for inner surface 13 of casing 3, unlike conventional whipstock 8 in FIG. 2. This provides support for at least a critical portion of whipstock 30, the critical portion being that area where mill 12 or other well tool in contacting guide surface 33 at the time of the tool's initial operation. Because of the support provided by second surface 36, whipstock 30 does not flex due to the weight imposed thereon by mill 12 and the pipe carrying same. This way mill 12 does not move down along the length of whipstock 30 more than is desired and whipstock 30 does not bend to provide preferential biting of mill 12 into guide surface 33 instead of inner surface 13 of casing 3.

Figure 4:
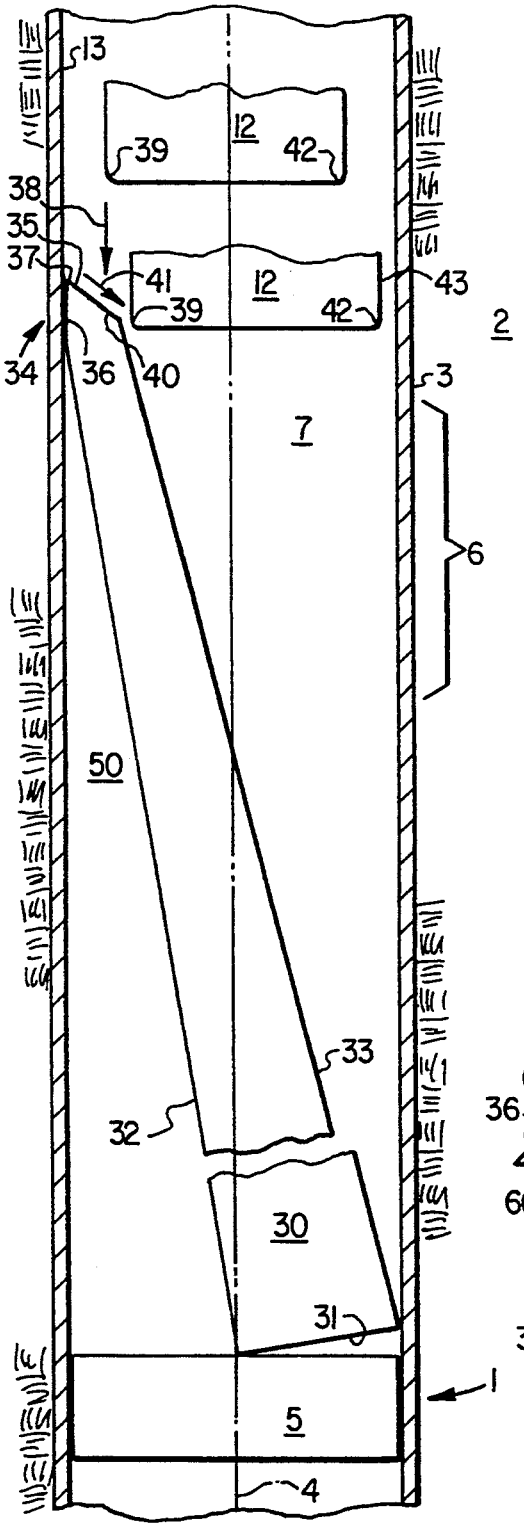
FIG. 4 shows the whipstock of this invention emplaced within a wellbore below a restriction in that wellbore and demonstrates the supported nature of the whipstock of this invention even though it is tilted at an angle to the long axis of the wellbore.

FIG. 4 shows mill 12 approaching first surface 35 as shown by arrow 38 so that corner 39 impinges upon first surface 35 at point 40. Since first surface 35 approaches guide surface 33, mill 12 is directed toward guide surface 33 as shown by arrow 41 until second corner 42 of mill 12 impinges upon inner surface 13 of casing 3. During this entire maneuver, this critical portion of whipstock 30 is fully supported by casing 3 because of the full contact of second surface 36 with inner surface 13. Thus, there is no flexure of whipstock 30 during this maneuver and, therefore, no encouragement for mill 12 to bite preferentially into guide surface 33 at corner 39. On the contrary, corner 42 can now preferentially bite into inner surface 13 due in part to the design of the cutting elements carried by mill 12 at its corners and along its gauge 43.

Thus, by use of the whipstock of this invention, a whipstock small enough to get through a restriction in inner space 7 above packer 5 can be used which will still support the whipstock in use in the area where support is needed. This is accomplished even though the whipstock, as emplaced, is tilted at angle to the long axis of the wellbore thereby providing unsupported space 50 between a substantial portion of back surface 32 and inner surface 13. By the use of the whipstock of this invention, it is far more likely that mill 12 will bite into inner surface 13 and thereby be pulled toward area 6 and away from guide surface 33 as desired. This eliminates the expenditure of substantial time and effort encountered when mill 12 cuts into and along guide surface 33.

Figure 5:
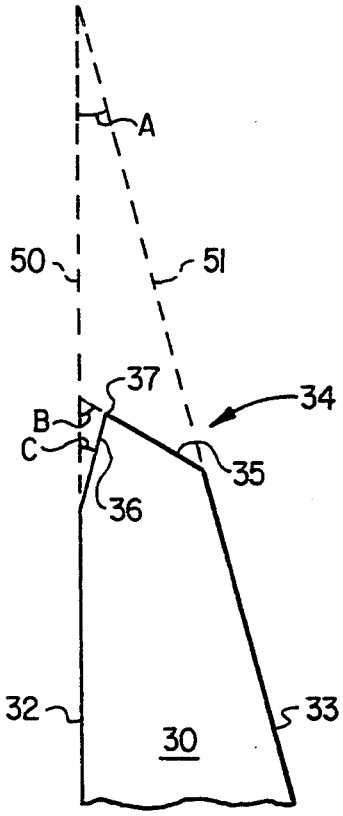
FIG. 5 shows the angular relationship of the various surfaces at one end of the whipstock of this invention.

FIG. 5 shows second end 34 of whipstock 30 in an enlarged embodiment to demonstrate the angular relationships between first and second surfaces 35 and 36. FIG. 5 shows second surface 36 to extend at an acute angle (C) with respect to back surface 32 while first surface 34 extends at an acute angle (B) with respect to back surface 32. Also shown in FIG. 5, by way of extensions 50 of back surface 32 and 51 of guide surface 33, guide surface 33 extends with relation to back surface 32 at acute angle (A).

In FIG. 5 it is shown that first and second surfaces 35 and 36 intersect at 37, first surface 35 intersects guide surface 33, and second surface 36 intersects back surface 32. Second end 34 can have more than just the two surfaces 35 and 36 and still be within the scope of this invention. All that is required is that first surface 35 approach guide surface 33 and second surface 36 approach back surface 32. There can be one or more additional surfaces between surfaces 35 and 33 so long as first surface 35 still approaches guide surface 33 to direct a well tool impinging thereon toward guide surface 33. Similarly, first and second surfaces 35 and 36 need not intersect but can have one or more surfaces there between, so long as the functions of first and second surfaces 35 and 36 are not altered. Second surface 36 need not intersect back surface 32 but can have one or more surfaces therebetween, so long as second surface 36 still approaches back surface 32 so that surface 36 can still perform the function of providing support for whipstock 30 when whipstock 30 is placed in a wellbore at an angle to the long axis of the wellbore as shown in FIG. 4. Thus, the lengths of first and second surfaces 35 and 36 can be essentially equal or can be different. In some situations it will be preferred that first surface 35 be longer than second surface 36, yet in other situations it will be preferred that second surface 36 be longer than first surface 35.

In discussing the angular relationships of surfaces 33, 35 and 36 it is preferred for consistency to deal with only the acute angles by which the various surfaces intersect back surface 32 or projection 50 thereof. Thus, this invention is described with respect to acute angles only, even though obtuse angles are also applicable. In a normal situation, angles (A), (B) and (C) are normally acute with angle (B) being greater than (A) or (C). Angles (A) and (C) can be, but are not necessarily, equal. When second surface 36 is longer than first surface 35, to assure that there is no flexure of whipstock 30 for at least the entire length of first surface 35, angle (C) will be an acute angle that is substantially smaller than angle (B) and somewhat smaller than angle (A). It must be understood that the angular relationships between angles (A), (B) and (C) is dependent on a number of other variables which will be obvious to those skilled in the art once apprised of the disclosure of this invention. This causes a myriad of variations, all of which are within the scope of this invention. For example, angles (A), (B) and (C) are dependent as to their magnitude on the length of whipstock 30, the internal diameter of casing 3, the wall thickness of casing 3, and the outside diameter of whipstock 30. Thus, the variations are too numerous to quantify but will be readily obvious to those skilled in the art. As a further example, if whipstock 30 is lengthened, angle (C) will be reduced, whereas if it is shortened, angle (C) will be increased, how much so depending on the amount of the lengthening or shortening as well whether the other various parameters set forth above change or stay the same. Generally, however, first angle (A) will normally be an acute angle of some finite magnitude although the magnitude can be less than one degree of curvature because the slope for guide surface 33 is desired to be as gradual as it is with conventional whipstock 8. Generally, third angle (C) will be acute and greater than about ten minutes of one degree in curvature as will first angle (A). Second angle (B) will generally be a finite acute angle of several degrees of curvature or more. Preferably, first and third angles (A) and (C) are each less than about five degrees, while second angle (B) is greater than about five degrees. Still more preferably, first and third angles (A) and (C) are each less than about three degrees, while second angle (B) is greater than about ten degrees.

Figure 6:
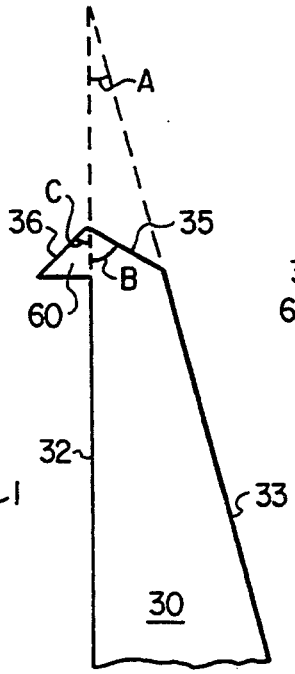
FIG. 6 shows another embodiment within this invention.

FIG. 6 shows an embodiment wherein second surface 36 is provided by way of a raised pad 60. In this embodiment, second surface 36 of pad 60 still approaches back surface 32 but from the left side thereof rather than the right side thereof as in FIGS. 3 through 5, and second surface 36 still extends at acute angle (C) with respect to back surface 32.

Figure 7:
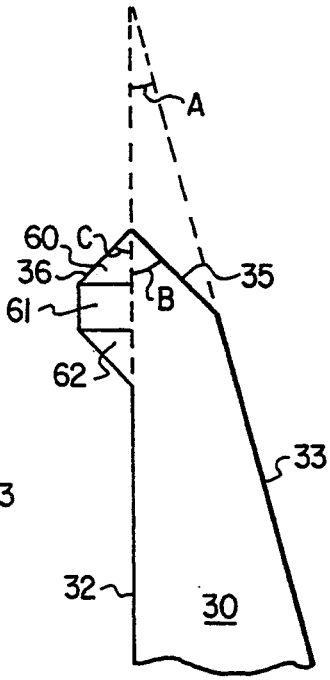
FIG. 7 shows yet another embodiment within this invention.

FIG. 7 shows pad 60 to be reinforced by a combination of straight side extension 61 and sloping side member 62. Various combinations of reinforcement for pad 60 can be employed in this invention. For example, extension 61 can be eliminated and member 62 substituted therefore.

In the method of this invention there is provided a process for carrying out well operations involving setting a whipstock in an elongate wellbore, said wellbore having a long axis and an internal surface along said long axis. The wellbore also has at least one internal restriction intermediate (along) its long axis whereby the whipstock, in order to be operative after passing through and below one or more internal restrictions, is set at an angle to the long axis of the wellbore so that a substantial length of the whipstock, as set in the wellbore, is unsupported by contact with the internal surface of the wellbore as shown in FIG. 4. In the method of this invention there is provided a whipstock with opposing upper and lower ends connected by opposing back and guide surfaces as described hereinabove, the guide surface extending at a first angle (A) with respect to the back surface. The upper end of the whipstock is defined by at least first and second surfaces 35 and 36 as aforesaid. The whipstock is then passed through at least one internal restriction in the wellbore and set in place in the wellbore below at least one internal restriction. The setting operation includes tilting the whipstock relative to the long axis of the wellbore as shown in FIG. 4 so that the second surface 36 essentially rests against an internal surface of the wellbore.

EXAMPLE

A whipstock essentially with the configuration shown in FIG. 4 is set into a wellbore as shown in FIG. 4 after passing through production tubing 20 shown in FIG. 2. The whipstock is about 15 feet in length and 3 and $\frac{3}{4}$ inches in diameter. In this whipstock, first angle (A) is 25 minutes of 1 degree, second angle (B) is 17 degrees and 35 minutes, and third angle (C) is 50 minutes of 1 degree. The whipstock is employed in the manner shown in FIG. 4 inside casing 3. Casing 3 has a 6.18 inch internal diameter. Production tubing 20 has an internal diameter of slightly greater than 3.75 inches. Thus, the whipstock passes through essentially a 3.75 inch diameter restriction before being set in the manner shown in FIG. 4. When a well tool reaches first surface 35 of the whipstock during a subsequent well operation, the whipstock essentially does not flex upon impingement by the tool or while the tool is being directed along first surface 35 to guide surface 33 because second surface 36 is in essential continual contact with the inner wall 13 of the wellbore.

Reasonable variations and modifications are possible within the scope of this disclosure without departing from the spirit and scope of this invention.

What is claimed is:

1. In a whipstock for emplacement in a wellbore having a longitudinal axis, said whipstock having first and second opposing ends joined by opposing back and guide surfaces, said guide surface extending at a first acute angle (A) with respect to said back surface, the improvement comprising said second end being defined by at least first and second surfaces, said first surface having a length which approaches said guide surface, said first surface extending at a second angle (B) with respect to said back surface, said second surface having a length which approaches said back surface, said second surface extending at a third angle (C) with respect to said back surface, said second and third angels (B and C) being acute angles, said first and second surfaces intersect one another, said first surface intersects said guide surface, and said second surface intersects said back surface, whereby said first surface directs a well tool impinging thereon toward said guide surface and said second surface provides support for said whipstock when said whipstock is placed in said wellbore at an angle to said longitudinal axis of said wellbore.

2. The invention set forth in claim 1 wherein:
said second angle (B) is greater than said first angle (A) and greater than said third angle (C).

3. The invention set forth in claim 1 wherein:
said first and third angles (A and C) are each greater than about 10 minutes of 1 degree.

4. The invention set forth in claim 1 wherein:
said second angle (B) and third angle (C) are finite acute angles.

5. The invention set forth in claim 1 wherein:
said lengths of said first and second surfaces are essentially equal.

6. The invention set forth in claim 1 wherein:
said lengths of said first and second surfaces are different.

7. The invention set forth in claim 6 wherein:
said second surface is longer than said first surface.

8. The invention set forth in claim 7 wherein:
said first and third angles (A and C) are each less than about 5 degrees, and said second angle (B) is greater than about 5 degrees.

9. The invention set forth in claim 7 wherein:
said first and third angles (A and C) are each less than about 3 degrees, and said second angle (B) is greater than about 10 degrees.

10. In a method for carrying out well operations involving setting a whipstock in an elongate wellbore having a longitudinal axis and an internal surface along said longitudinal axis, said wellbore having at least one internal restriction along said longitudinal axis whereby said whipstock in order to be operative after passing through and below said at least one internal restriction is set at an angle to said longitudinal axis so that a substantial length of said whipstock as set in said wellbore is unsupported by contact with said internal surface of said wellbore, the improvement comprising providing a whipstock with opposing upper and lower ends connected by opposing back and guide surfaces, said guide surface extending at a first angle (A) with respect to said back surface, said upper end being defined by at least first and second surfaces, said first surface approaching said guide surface and extending at a second angle (B) with respect to said back surface, said second surface approaching said back surface and extending at a third angle (C) with respect to said back surface, passing said whipstock through at least one internal restriction in said wellbore, setting said whipstock in place in said wellbore below said at least one internal restriction including tilting said whipstock relative to said longitudinal axis of said wellbore so that said second surface essentially rests against said internal surface of said wellbore.

11. The invention set forth in claim 10 wherein:
said second angle (B) is greater than said first angle (A).

12. The invention set forth in claim 10 wherein:
said first and third angles (A and C) are each greater than about 10 ten minutes of 1 degree.

13. The invention set forth in claim 10 wherein:
said second angle (B) and third angle (C) are any finite acute angle.

14. The invention set forth in claim 10 wherein:
said lengths of said first and second surfaces are essentially equal.

15. The invention set forth in claim 10 wherein:
said lengths of said first and second surfaces are different.

16. The invention set forth in claim 15 wherein:
said second surface is longer than said first surface.

17. The invention set forth in claim 16 wherein:
said first and third angles (A and C) are each less than about 5 degrees, and said second angle (B) is greater than about 5 degrees.

18. The invention set forth in claim 16 wherein:
said first and third angles (A and C) are each less than about 3 degrees, and said second angle (B) is greater than about 10 degrees.

19. The invention set forth in claim 10 wherein:
said first and second surfaces intersect one another, said first surface intersects said guide surface, and said second surface intersects said back surface.

* * * * *